US007170005B1

(12) United States Patent
King, Jr. et al.

(10) Patent No.: US 7,170,005 B1
(45) Date of Patent: Jan. 30, 2007

(54) DIRECT BURY CONNECTOR

(76) Inventors: Lloyd Herbert King, Jr., 394 Larimore Valley Dr., Chesterfiled, MO (US) 63005; Michael Belgeri, 1007 Bridgeport, Ellisville, MO (US) 63011; James C. Keeven, 2641 Whitetail La., O'Fallon, MO (US) 63366

( * ) Notice: Subject to any disclaimer, the term of this patent is extended or adjusted under 35 U.S.C. 154(b) by 0 days.

(21) Appl. No.: 11/260,014

(22) Filed: Oct. 27, 2005

Related U.S. Application Data

(63) Continuation-in-part of application No. 10/928,669, filed on Aug. 26, 2004, now Pat. No. 7,122,742, which is a continuation-in-part of application No. 10/654,076, filed on Sep. 3, 2003, now Pat. No. 6,815,616.

(51) Int. Cl.
*H01R 4/00* (2006.01)

(52) U.S. Cl. ..... 174/84 R; 174/88 R

(58) Field of Classification Search ..... 174/74 R, 174/77 R, 84 R, 84 S, 86, 87; 439/449
See application file for complete search history.

(56) References Cited

U.S. PATENT DOCUMENTS 2,925,461 A * 2/1960 Anderson ..... 174/87
4,839,473 A * 6/1989 Fox et al. ..... 174/138 F
5,023,402 A 6/1991 King, Jr. et al. ..... 174/87
5,113,037 A 5/1992 King, Jr. et al. ..... 174/87
5,151,239 A 9/1992 King, Jr. et al. ..... 264/272.11
5,162,617 A * 11/1992 Ferbas ..... 174/138 F
5,252,779 A * 10/1993 DiRienzo ..... 174/87
5,373,107 A * 12/1994 Thomas et al. ..... 174/87
5,427,270 A * 6/1995 Patterson ..... 174/135
5,431,758 A * 7/1995 Delalle ..... 156/49
6,025,559 A * 2/2000 Simmons ..... 174/87
6,051,791 A * 4/2000 King ..... 174/87
6,478,606 B1 * 11/2002 McNerney et al. ..... 439/415
6,815,616 B1 * 11/2004 King et al. ..... 174/87

OTHER PUBLICATIONS

3M, DBR Direct Bury Splice Kit, Data Sheet, Nov. 1, 1991.
3M, DBR Direct Bury Splice Kit 600 Volts, Data Sheet, Nov. 1, 1991.
3M, DBY/DBR AMD DBY-6/DBR/6 Direct Bury Splice Kits, Data Sheet, 1993.

* cited by examiner

*Primary Examiner*—William H. Mayo, III
(74) *Attorney, Agent, or Firm*—Jacobson & Johnson

(57) ABSTRACT

A direct bury twist-on wire connector for securing an electrical connection having a tube with an integral twist-on wire connector graspable from outside the tube while the inside of the tube and the inside of the twist-on wire connector carry a sealant therein and a cap secureable to an open end of the tube to inhibit strain on the wires to thereby provide a ready-to-bury connector.

20 Claims, 5 Drawing Sheets

15
15a
19
11a
17
10
16
14
18
16a
11
12
12a 12
10
12a
11
18
17
16
20
14
19
15
13

DIRECT BURY CONNECTOR

CROSS REFERENCE TO RELATED APPLICATIONS

This application is a continuation-in-part of U.S. application Ser. No. 10/928,669 titled STRAIN RELIEVED WIRE CONNECTOR filed Aug. 26, 2004 (pending), which is a continuation in part of application No. 10/654,076 titled STRAIN RELIEVED WIRE CONNECTOR filed Sep. 3, 2003 which is now U.S. Pat. No. 6,815,616.

FIELD OF THE INVENTION

This invention relates generally to direct bury electrical connectors and, more specifically, to a direct bury twist-on wire connector providing strain relief that can be quickly brought into a ready-to-bury condition and, if necessary, allow an electrical connection in the direct bury twist-on wire connector to be reworked.

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of waterproof twist-on wire connectors wherein a sealant is placed in the cavity of a twist-on wire connector is known in the art and is shown in U.S. Pat. Nos. 5,113,037; 5,023,402 and 5,151,239. In these type of connectors the wires are inserted through a pierceable cover and into a sealant in the twist-on wire connector cavity. In some embodiments sleeves are placed on the wire connector to contain extra sealant. In a further embodiment the connector includes clips for looping the wires thereon to prevent the wires from pulling out of the twist-on wire connector.

A system widely used in installing underground electrical systems, is known as a direct bury splice kit. The kit includes, a twist-on wire connector, a housing with an integral cover that is closeable on the wires to provide stain relief. One such kit is sold by the 3M electrical products of Austin Tex. The kit comprises a twist-on wire connector that contains no sealant and an elongated tube that contains a sealant. The twist-on wire connector and the tube are both stored loosely in a plastic package that must be breached before the twist-on wire connector and the elongated tube can be used. The elongated tube contains a sealant in a closed end of the tube and a cover proximate an open end of the tube. The cover can be closed on wires extending into the tube to provide strain relief.

While the Direct Bury Splice Kit is an effective solution for underground burial of electrical splices in order to use the 3M Direct Bury Splice Kit one must first remove both the twist-on wire connector and the elongated tube from a shipping package. One then secures the twist-on wire connector to the wires. Next, the twist-on wire connector is inserted into the sealant in the closed end of the elongated tube. The twist-on wire connector is then forced downward into the sealant until the twist-on wire connector extends past locking fingers, which are located on the inside of the tube, to thereby lock the twist-on wire connector in the elongated tube to prevent withdrawal of the twist-on wire connector. Finally, the cover, which is attached to the tube, is closed to hold the wires in the tube. The direct bury kit is then ready for burial. However, if the connection needs to be changed, that is if one discovers an additional wire needs to be included in the splice in the twist-on wire connector or if the splice needs to be reworked one must either cut the wires and use another direct bury splice kit or cut the elongated tube to free the twist-on wire connector which enables one to reuse the twist-on wire connector. If the wires are cut the remaining wires might not be long enough to make a new connection. On the other hand, if the wires and twist-on wire connector are removed from the tube a new tube is required since the tube needs to be destroyed to remove the twist-on wire connector which is locked therein by locking fingers on the tube walls. In addition, once the twist-on wire connector is removed from the tube the exterior of the twist-on wire connector is covered with sealant making it difficult to handle and reuse the twist-on wire connector to secure a new connection therein.

In contrast to the prior art 3M Direct Bury Splice Kit the present invention provides a direct bury twist-on wire connector that is an integral part of a one-piece tube, which eliminates the handling of a separate wire connector that is susceptible to being lost when the shipping package with the direct bury twist-on wire connector is opened. In the present invention, the wires to be connected are inserted directly into the twist-on wire connector that is integral with a tube having a closure thereon. The outer portion of the twist-on wire connector forms part of an exterior portion of the tube to enable one to grip the twist-on wire connector for rotation thereof and the inner portion of the twist-on wire connector cooperates with tube to carry the sealant. When the tube with the integral twist-on wire connector is rotated with respect to the wires it brings the electrical wires into an electrical connection. Once the cap is closed the direct bury connector of the present invention inhibits strain on the wires therein through pressure engagement between the cover and the tube leaving the direct bury connector ready for underground burial.

An advantage of the present invention over the direct bury splice kit is that if additional wires need to be added or if the splice needs to be reworked the direct bury connector can be reused without the user having to handle a sealant covered twist-on wire connector. A further advantage is that if a rework of the splice or if additional wire are required the user does not have to cut away the old elongated tube and insert the twist-on wire connector into a new elongated tube of sealant since the tube of direct bury connector of the present invention can be reused. Thus, not only is the present invention more convenient to use it generates less waste.

SUMMARY OF THE INVENTION

A direct bury twist-on wire connector for securing an electrical connection comprising a tube and cap with the tube having an integral twist-on wire connector graspable from outside the tube while the inside of the tube and the inside of the twist-on wire connector carry a sealant therein with the cap thereon secureable to the tube to inhibit strain on the wires to thereby provide a ready-to-bury connector.

DESCRIPTION OF THE PREFERRED EMBODIMENT

Figure 1:
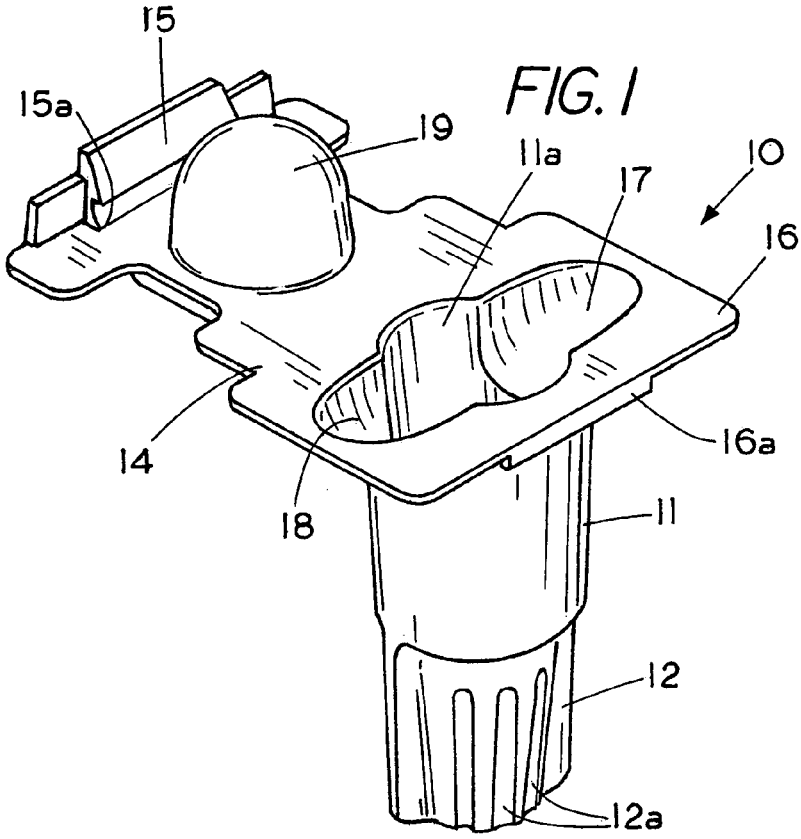
FIG. 1 is a bottom perspective view of the direct bury connector in an open condition.
Figure 2:
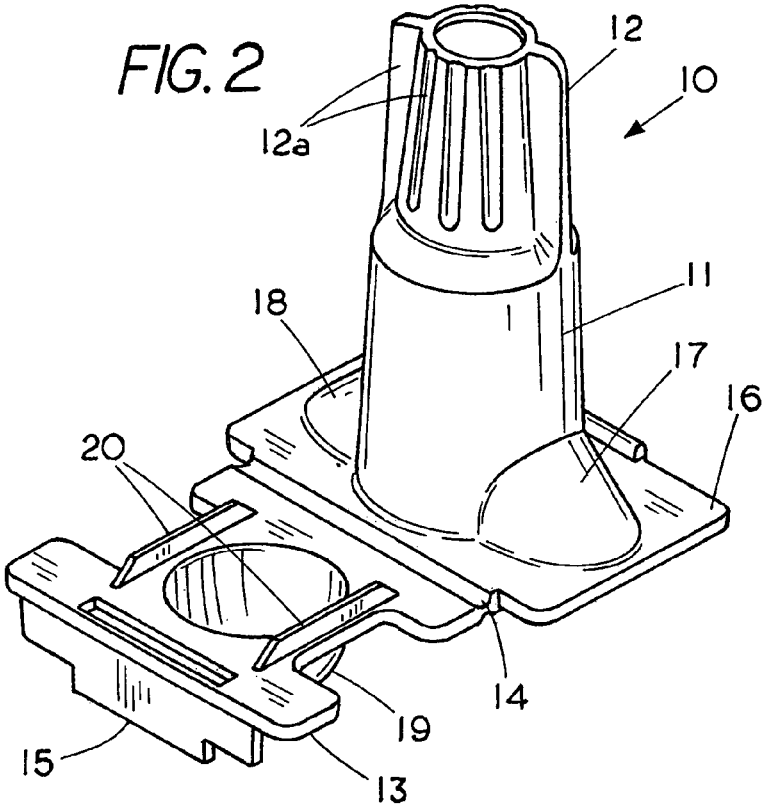
FIG. 2 is a top perspective view of the direct bury connector in an open condition.

FIG. 1 shows a bottom perspective view of a one-piece direct bury connector 10 for use in underground locations where moisture can be expected and where one needs to inhibit strain on an electrical connection. FIG. 2 shows a top perspective view of the one-piece direct bury connector 10. Referring to FIG. 1 and to FIG. 2 the direct bury connector comprises a semi rigid elongated tube 11 made from a polymer plastic and having a twist-on wire connector forming a closed end 12 of tube 11. Tube 11 includes an open end 11*a* having a cover or cap 13 that can be brought into a closed condition on the open end 11*a* of tube 11 through a living hinge 14. That is, the exterior of twist-on wire connector 12 forms a grasping surface for the twist-on wire connector 12 with the grasping surface containing elongated ribs 12*a*. Extending laterally from the open end 11*a* of tube 11 are a first lateral wire passage 17 and a second lateral wire passage 18 that terminate in a lip 16 that extends radially outward from tube 11. A living hinge 14 connects cover 13 to lip 16 and allows the cover 13 to be brought from an open condition as shown in FIG. 1 and FIG. 2 to the closed condition illustrated in FIG. 3. Tube 11 with open end 11*a* and closed end 12, cover 13 and hinge 14 can be formed in one piece by molding or the like.

The cover 13 includes a latch 15 with a latch lip 15*a* for engaging an edge 16*a* on the lip 16. (see FIG. 3) Molded into the cover 13 is a thin shelled hemispherical shaped protrusion or dome 19 that can flex under pressure to accommodate and frictionally hold wires there against as well as against the side wire passages 17 and 18. The flexing of dome 19 against the wires squeezes the wires and produces a frictional grip on the wires to hold the wires in place and thereby inhibit strain on the electrical connection in the twist-on connector 12. A cover with an integral dome is shown in the data sheet for the Direct Bury Splice Kit of 3M as well as a set of cover reinforcing ribs 20 that are located on the exterior side of cover 13.

Figure 3:
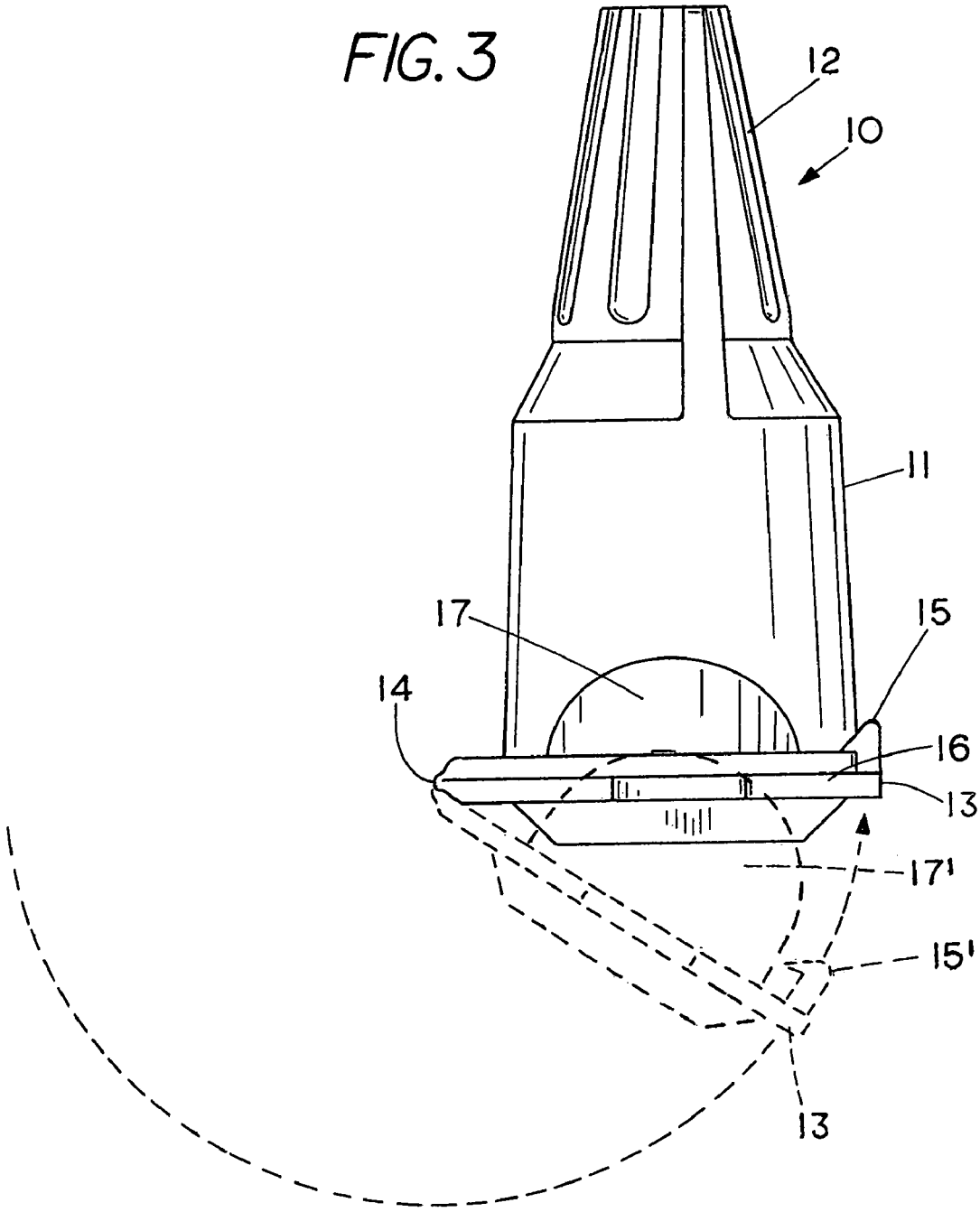
FIG. 3 is a side view of the direct bury connector in a closed condition.

FIG. 3 shows the direct bury connector 10 in the closed condition with the cover 13 in engagement with lip 16 through the latch 15. The dashed lines 15' indicate the movement of the cover from the open condition, as shown in FIGS. 1 and 2, to the closed condition shown in FIG. 3 through the pivoting of the cover 13 about the living hinge 14.

Figure 4:
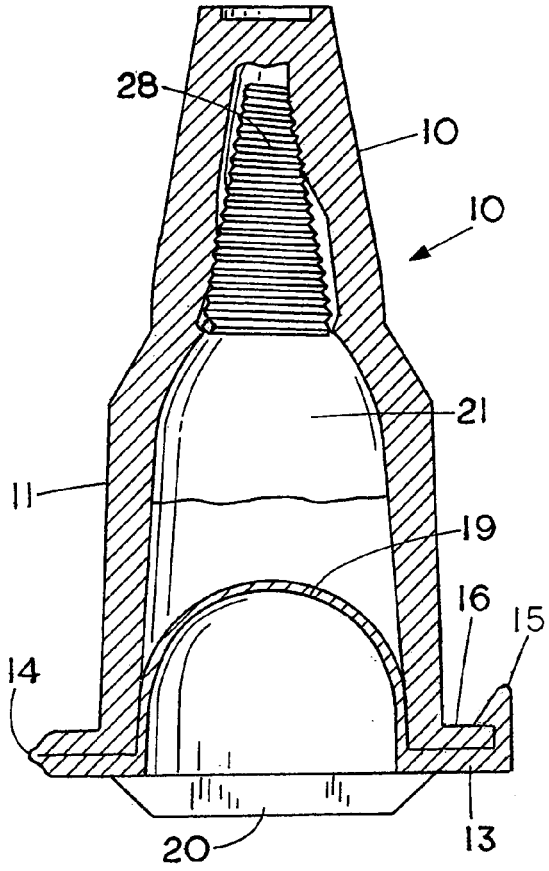
FIG. 4 is a sectional view of the direct bury connector in a closed condition.

FIG. 4 is a section view of the direct bury connector 10 revealing the spiral coil 28 in the closed end 12 of the tube 11. In addition, sealant 21 such as petroleum grease, silicone or the like is carried in the tube 11 and extends into and over the spiral coil 28. The spiral coil 28 is of the type used in twist-on wire connectors and allows wires to be drawn into electrical contact with each other by rotating the wires with respect to each other while the ends of the wires are located in the twist-on wire connector. Such selant containing twist-on wire connectors are more full shown and described in King et al. U.S. Pat. Nos. 5,113,037; 5,023,402 and 5,151,239.

Figure 4A:
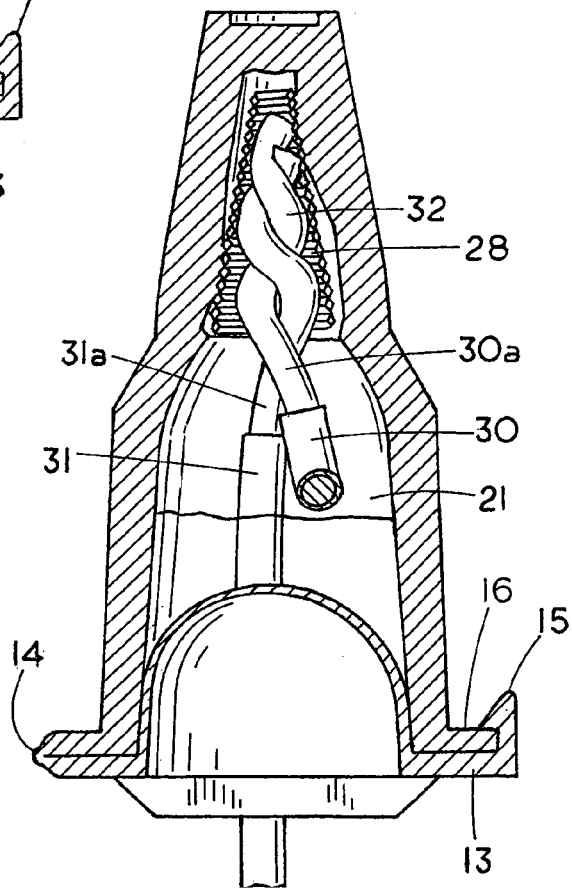
FIG. 4A is a section view of the direct bury connector shown in FIG. 4 with a set of electrical wires therein.

FIG. 4A shows the sectional view of FIG. 4 with a set of electrical wires 30 and 31 having stripped ends 30*a* and 31*a* forming an electrical connection 32 in the spiral coil 28. As can be seen the sealant 21 surrounds the stripped ends 30*a* and 31*a* as well as the electrical connection 32 provide a protective covering over the stripped ends of the electrical wires 30 and 31. In this condition the latch 15, which can flex to slide into engagement with lip 16 holds the cover 13 in the closed condition. By closing the cover 13 the direct bury connector 10 is placed in a ready-to-bury condition.

Figure 4B:
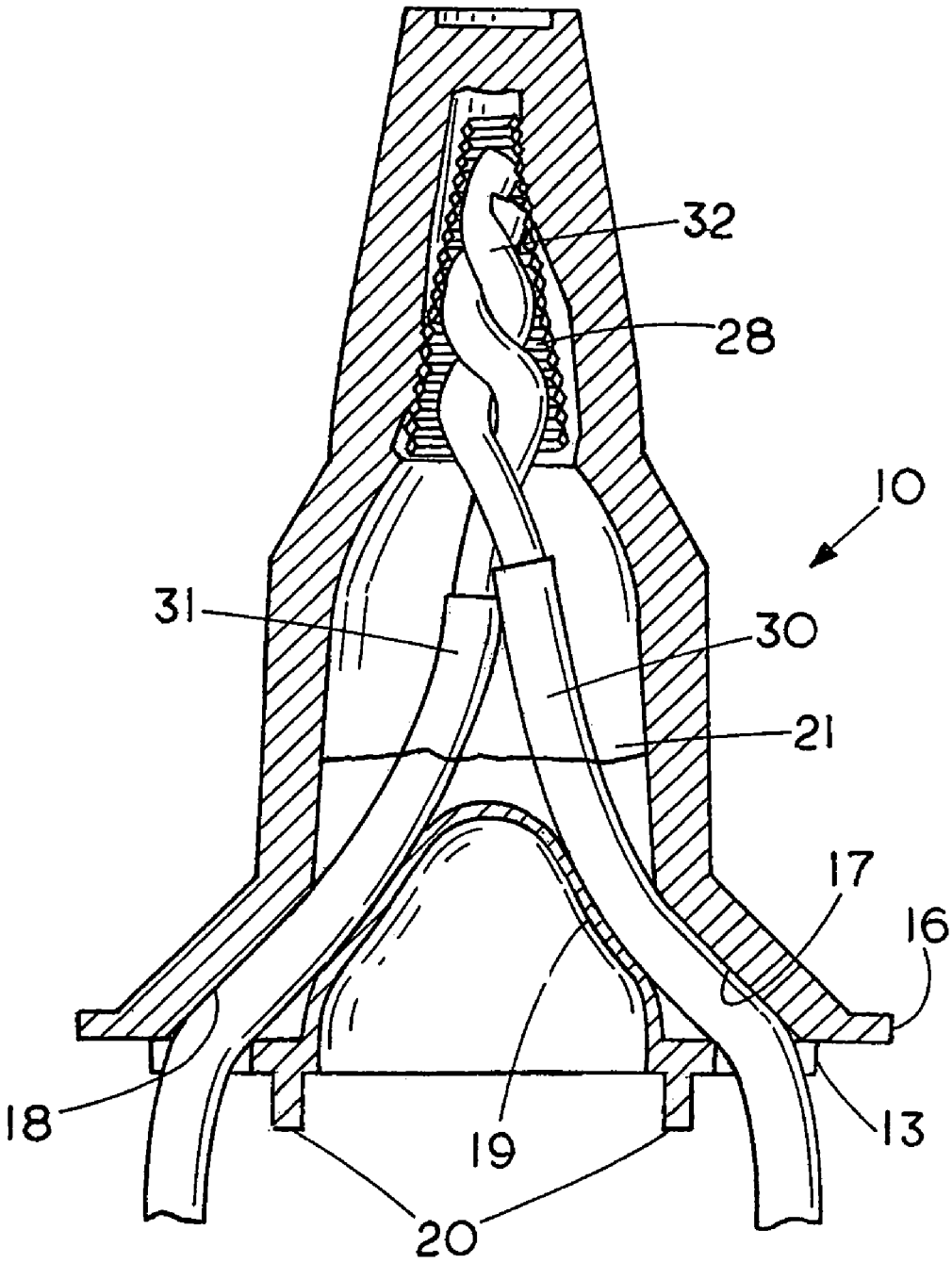
FIG. 4B is a sectional view taken of the direct bury wire connector of FIG. 1 taken though the wire passages.

In order to reveal the restraint of the electrical wires 30 and 31 FIG. 4B shows a section view taken through lateral passages 17 and 18 to reveal how the wire 30 is frictionally held between wire passage 17 and dome 19 and how wire 31 is frictionally held between wire passage 18 and dome 19. In each case the closing of cover 13 causes the dome 19 to resistantly flex to thereby provide a squeezing force on the wires 30 and 31 thus frictionally hold the wires 30 and 31 in the direct bury connector 10 and thereby inhibiting strain on the electrical connection 32 located in spiral coil 28.

Thus, the invention includes a method of making a direct bury electrical connection by inserting a set of electrical wires 30 and 31 into an open end of a tube 11 having a closed end with a sealant and an integral twist-on wire connector 12, twisting the set of wires 30 and 31 with respect to the integral twist-on wire connector 12 to form an electrical connection therein and closing a cover 13 to secure the set of wires 30 and 31 to the tube 11 to thereby inhibit strain on the electrical connection.

The invention also includes adding a further wire to the set of wires 30 and 31 by removing the set of wires from the integral twist-on wire connector 12 without rupturing the tube, that is by rotating the twist-on wire connector in the opposite direction one can free the wires therefrom. After freeing the wires from the twist-on wire connector 12 one can insert a further wire into the integral twist-on wire connector with the wires 30 and 31 and by twisting the further wire and the set of wires 30 and 31 one can reestablish an electrical connection in the integral twist-on wire connector thus allowing reuse of the direct bury connector 10.

One can then close the cover 13 on the tube 11 to frictionally engage the wires therein and thereby bring the direct bury electrical connector into condition for burial. Thus the invention provides for in situ formation of an electrical connection and if desired in situ formation of a frictional grasp of the wires to thereby inhibit strain on the electrical connection.

The invention further includes the method of making a direct bury connector by molding a direct bury connector 10 with a tube 11 to carry a sealant and a spiral core with the tube formed with a closed end 12 with exterior grasping regions for rotating the tube 11. By inserting a spiral coil 28 into the closed end 12 of the tube and then inserting a sealant into the spiral coil 28 and the tube 11 one generates a ready to use direct bury electrical connector 10.

Figure 5:
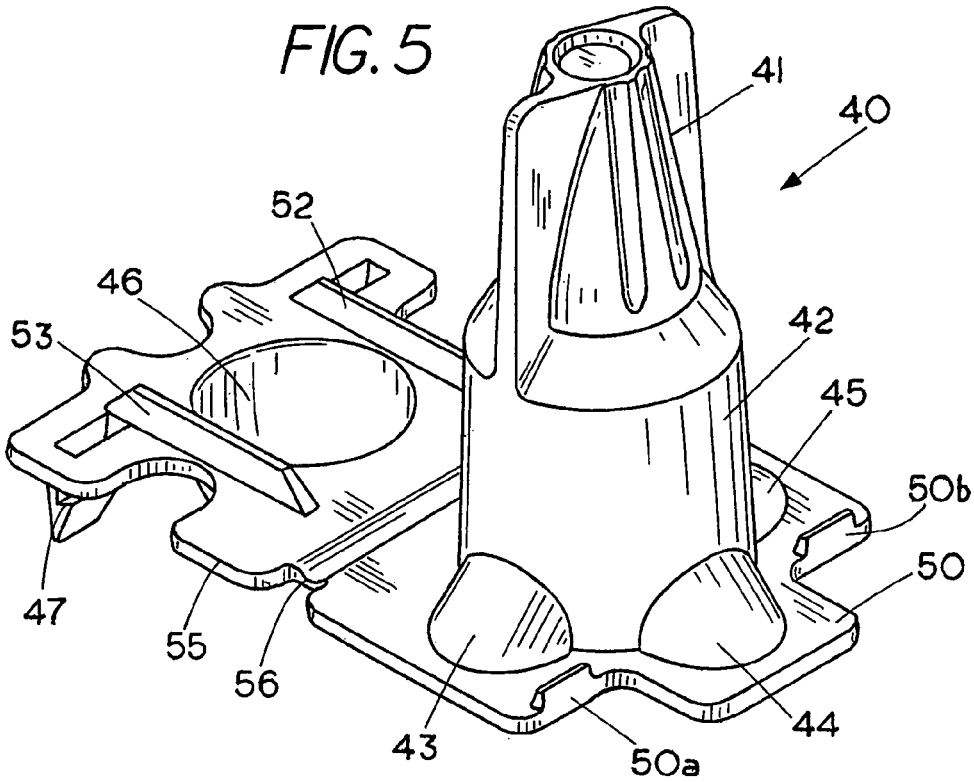
FIG. 5 is a top perspective view of alternate embodiment of a direct bury wire connector with three lateral wire passages.
Figure 6:
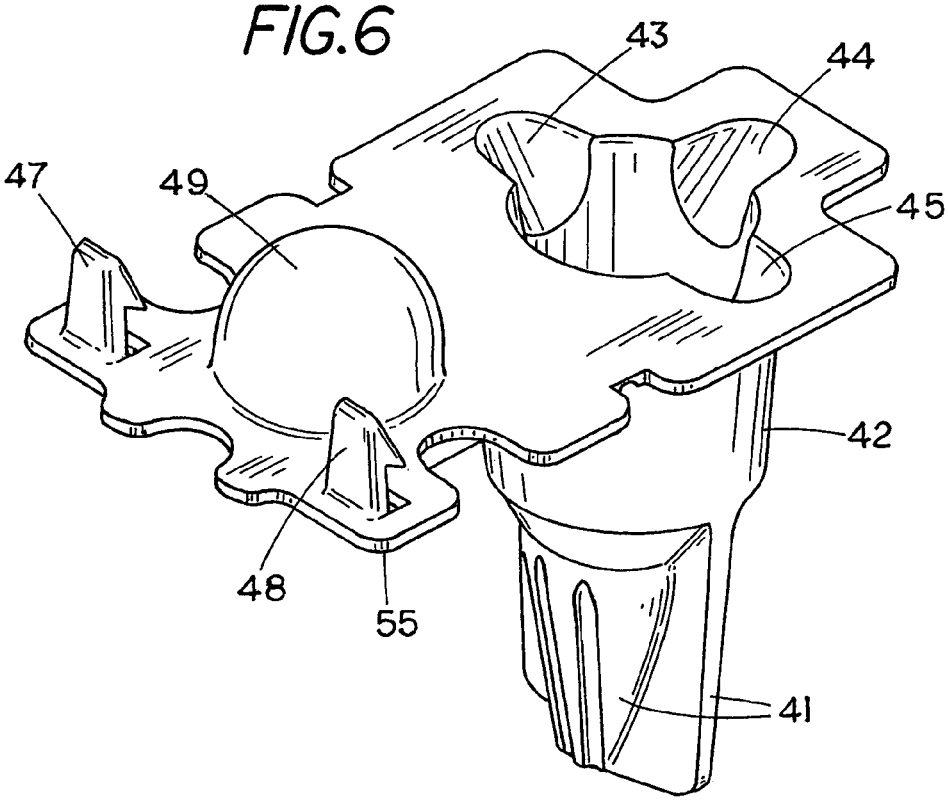
FIG. 6 is a bottom perspective view of the embodiment of direct bury wire connector of FIG. 5.

FIG. 5 and FIG. 6 shows an alternate embodiment 40 of a direct bury connector having an elongated tube 41 with a closed end and an open end. The embodiment of FIG. 5 and FIG. 6 is substantially identical to the embodiment of FIGS.

1–4 but includes an additional wire passages thereby providing three wire passages 43, 44 and 45 that extend laterally from the elongated tube 42 to a lip 50 with the lip 50 having legs 50*a* and 50*b* for engaging a latch 47 and a latch 48 on cover 55. A living hinge 56 connects cover 55 with lip 50. A hemispherical dome 49 extends from cover 55 similar to the dome 19 to provide for frictional engagement of wires that are in passages 43, 44 and 45. The integral twist-on wire connector 41 forms the closed end of the direct bury connector and the tube 42 forms a portion of the sealant carrying portion of the direct bury wire connector 40.

We claim:

1. A direct bury electrical connector comprising:

a tube having a wire passage and an open end;

a sealant carried in said tube;

a twist-on wire connector integrally forming a closed end of said tube so that an electrical connection can be formed in the twist-on wire connector by inserting a set of electrical wires into the open end of said tube and into the twist-on wire connector which can then be rotated to form the electrical connection in the presence of the sealant; and a tube cover closeable to hold the set of electrical wires between the wire passage and the tube cover to inhibit strain on the electrical connection in the direct bury electrical connector.

2. The direct bury electrical connector of claim 1 wherein the tube cover includes a dome for flexingly engaging a wire to frictionally hold the wire in postion.

3. The direct bury electrical connect of claim 2 wherein the tube is a polymer plastic.

4. The direct bury electrical connector of claim 3 wherein the tube cover connects to the tube through a living hinge.

5. The direct bury electrical connector of claim 1 including at least two lateral wire passages on said tube for receiving a wire therein.

6. The direct bury electrical connector of claim 1 wherein the twist-on wire connector, the tube and the cover are one-piece.

7. The direct bury electrical connector of claim 1 wherein the twist-on wire connector exterior surface forms part of the tube.

8. The direct bury electrical connector of 1 wherein the sealant in the twist-on wire connector is carried in both the tube and a spiral thread in the twist-on wire connector.

9. The direct bury electrical connector of claim 1 wherein the cover includes a latch for holding the cover in a closed condition.

10. A method of making a direct bury electrical connection comprising:

inserting a set of electrical wires into an open end of a tube having a closed end with a sealant and an integral twist-on wire connector;

twisting the set of wires with respect to the integral twist-on wire connector to form an electrical connection therein; and closing a cover to secure the set of wires between the cover and a wire passage in the elongated tube to thereby inhibit strain on the electrical connection.

11. The method of claim 10 including the step of adding a further wire to the set of wires by removing the set of wires from the integral twist-on wire connector without rupturing the container;

inserting the further wire into the integral twist-on wire connector; and twisting the further wire and the set of wires to reestablish an electrical connection in the integral twist-on wire connector.

12. The method of claim 10 including the step of burying the direct bury electrical connector.

13. The method of claim 10 including the step of using a living hinge to close the cover of the tube.

14. The method of claim 10 including the step of frictionally engaging the set of wires between the cover and the tube to frictionally hold the set of wires in a strain relived condition.

15. The method of claim 10 including the removal of the direct bury electrical connector from a package with the direct bury electrical connector in a ready to use condition.

16. The method of claim 10 including the step of latching the cover to the tube to form a closed tube.

17. The method of claim 10 wherein the integral twist-on wire is grasped on a set of ribs on an exterior portion of the tube.

18. The method of making a direct bury connector comprising;

forming a tube with an open end and a closed end having an exterior grasping region and an interior region for receiving a spiral coil for a twist-on wire connector;

forming a cover for closing the open end of the tube and frictionally holding wires between the cover and the tube when the cover is in a closed condition; and inserting a sealant into the tube and into the spiral coil to form a ready-to-use direct bury connector.

19. The method of claim 18 including the step of forming an integral cover to the tube.

20. The method of claim 18 including the step of forming a lateral wire passage on the tube.

* * * * *

US007170005C1

(12) EX PARTE REEXAMINATION CERTIFICATE (9422nd)

United States Patent

King, Jr. et al.

(10) Number: US 7,170,005 C1

(45) Certificate Issued: Nov. 26, 2012

(54) DIRECT BURY CONNECTOR

(75) Inventors: Lloyd Herbert King, Jr., Chesterfiled, MO (US); Michael Belgeri, Ellisville, MO (US); James C. Keeven, O'Fallon, MO (US)

(73) Assignee: The Patent Store LLC, O'Fallon, MO (US)

Reexamination Request:
No. 90/012,137, Feb. 13, 2012

Reexamination Certificate for:

| | |
|---|---|
| Patent No.: | **7,170,005** |
| Issued: | **Jan. 30, 2007** |
| Appl. No.: | **11/260,014** |
| Filed: | **Oct. 27, 2005** |

Related U.S. Application Data

(63) Continuation-in-part of application No. 10/928,669, filed on Aug. 26, 2004, now Pat. No. 7,122,742, which is a continuation-in-part of application No. 10/654,076, filed on Sep. 3, 2003, now Pat. No. 6,815,616.

(51) Int. Cl.
*H01R 4/00* (2006.01)

(52) U.S. Cl. ..... 174/84 R; 174/88 R

(58) Field of Classification Search ..... None
See application file for complete search history.

(56) References Cited

To view the complete listing of prior art documents cited during the proceeding for Reexamination Control Number 90/012,137, please refer to the USPTO's public Patent Application Information Retrieval (PAIR) system under the Display References tab.

*Primary Examiner* — John Heyman

(57) ABSTRACT

A direct bury twist-on wire connector for securing an electrical connection having a tube with an integral twist-on wire connector graspable from outside the tube while the inside of the tube and the inside of the twist-on wire connector carry a sealant therein and a cap secureable to an open end of the tube to inhibit strain on the wires to thereby provide a ready-to-bury connector.

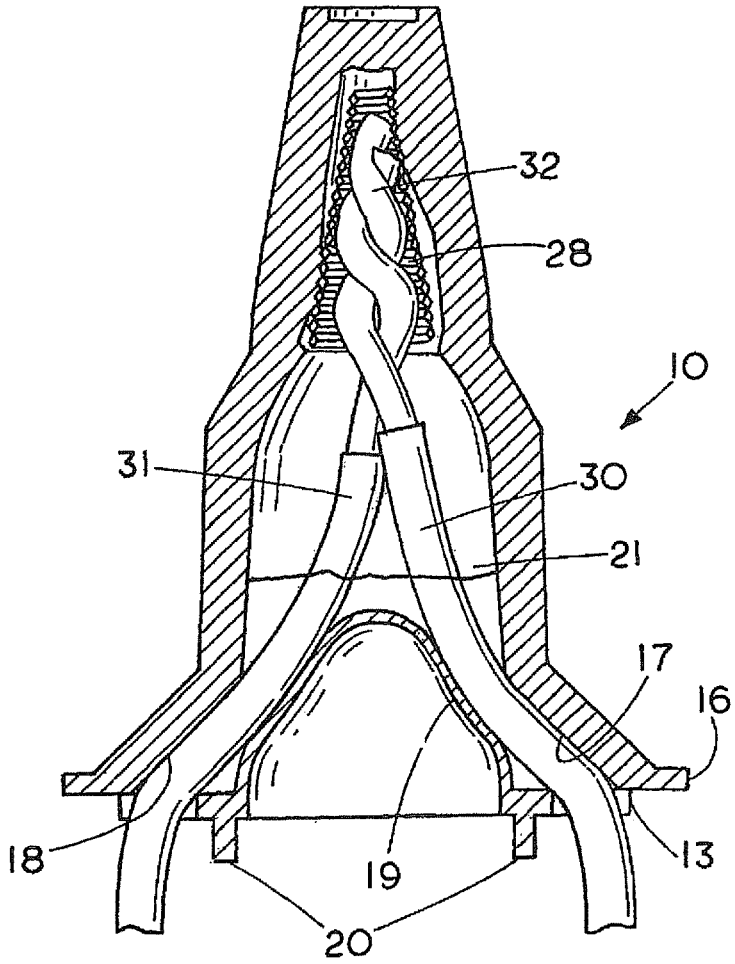

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-20 is confirmed.

* * * * *